US009844289B2

(12) United States Patent
Gerster

(10) Patent No.: US 9,844,289 B2
(45) Date of Patent: Dec. 19, 2017

(54) RIBBON-TYPE DEVICE

(71) Applicant: Gustav Gerster GmbH & Co. KG, Biberach (DE)

(72) Inventor: Martin M. Gerster, Biberach (DE)

(73) Assignee: Gustav Gerster GmbH & Co. KG, Biberach (DE)

( * ) Notice: Subject to any disclaimer, the term of this patent is extended or adjusted under 35 U.S.C. 154(b) by 357 days.

(21) Appl. No.: 14/011,040

(22) Filed: Aug. 27, 2013

(65) Prior Publication Data

US 2014/0060759 A1 Mar. 6, 2014

Related U.S. Application Data

(60) Provisional application No. 61/693,863, filed on Aug. 28, 2012.

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***A47H 5/032*** | (2006.01) |
| ***A47H 13/14*** | (2006.01) |

(52) U.S. Cl.

CPC ..... *A47H 5/032* (2013.01); *A47H 13/14* (2013.01)

(58) Field of Classification Search

CPC ..... A47H 5/032; A47H 13/14; A47H 13/00; A47H 13/16; E06B 9/262; E06B 9/26

USPC .... 160/84.01, 84.04, 84.05, 168.1 R, 173 R, 160/178.3, 178.1 R, 177 R

See application file for complete search history.

(56) References Cited

U.S. PATENT DOCUMENTS

| | | | | |
|---|---|---|---|---|
| 2,159,733 | A * | 5/1939 | French | 160/344 |
| 3,952,788 | A * | 4/1976 | Scholer | 160/84.01 |
| 4,765,388 | A * | 8/1988 | Dohlemann | E06B 9/262 160/348 |
| 4,899,796 | A * | 2/1990 | Easley | E06B 9/262 160/84.01 |
| 5,495,883 | A * | 3/1996 | Jelic | 160/84.04 |
| 6,792,995 | B2 * | 9/2004 | Judkins | 160/84.04 |
| 7,975,747 | B2 * | 7/2011 | Liang et al. | 160/84.04 |
| 8,474,507 | B2 * | 7/2013 | Anthony et al. | 160/84.01 |
| 9,074,409 | B2 * | 7/2015 | Liang et al. | |
| 2008/0251216 | A1 * | 10/2008 | Hsu | E06B 9/262 160/84.01 |
| 2011/0132555 | A1 * | 6/2011 | Rowley et al. | 160/340 |

(Continued)

*Primary Examiner* — Katherine Mitchell
*Assistant Examiner* — Jeremy Ramsey
(74) *Attorney, Agent, or Firm* — Bachman & LaPointe, P.C.

(57) ABSTRACT

A ribbon-type device effects undulation of a curtain for gathering the same in the vertical or horizontal direction. A functional unit comprises two tapes of fabric, each of which extends in an undulating manner to form a plurality of alternating positively and negatively curved arcs. An arc of positive curvature of a first fabric tape is set so as to oppose an arc of negative curvature of a second fabric tape and an arc of negative curvature of the first fabric tape is set so as to oppose an arc of positive curvature of the second fabric tape. The two fabric tapes are joined to each other at each transition between an arc of positive curvature and an arc of negative curvature by means of tie-off stitching (tie-offs). A plurality of such tie-offs accommodate a pull cord of a curtain.

5 Claims, 4 Drawing Sheets

(56) References Cited

U.S. PATENT DOCUMENTS

| | | | | |
|---|---|---|---|---|
| 2012/0168094 | A1* | 7/2012 | Lin | 160/84.04 |
| 2012/0227910 | A1* | 9/2012 | Lin | 160/84.01 |

* cited by examiner

RIBBON-TYPE DEVICE

CROSS-REFERENCE TO RELATED APPLICATION

Benefit is claimed of U.S. patent application Ser. No. 61/693,863, filed Aug. 28, 2012, and entitled "Ribbon-Type Device", the disclosure of which is incorporated by reference herein in its entirety as if set forth at length.

BACKGROUND OF THE INVENTION

The invention relates to a ribbon-type device for effecting undulation in the form of an accommodation means for a pull cord of a curtain for gathering the same in the vertical or horizontal direction.

Ribbon-type devices for effecting undulation of the above type are known in the prior art in a number of various embodiments. The known devices, however, suffer from the serious drawback that the pull cord or other cords can form large loops in which body parts, in particular, such as a finger, an arm or even the head of a child can become entangled, and this has resulted in considerable injuries in the past.

SUMMARY OF THE INVENTION

It is therefore an object of the present invention to provide a ribbon-type device for effecting undulation in the form of an accommodation means for a pull cord of a curtain, which device safeguards against injuries and, at the same time, enables the curtain to be gathered rapidly and effectively.

For a ribbon-type device for effecting undulation of the above type, this object is achieved, according to the invention, in that there is provided a functional unit comprising two tapes of fabric, each of which extends in an undulating manner to form a plurality of alternating positively and negatively curved arcs, an arc of positive curvature of the first fabric tape being set so as to oppose an arc of negative curvature of the second fabric tape and an arc of negative curvature of the first fabric tape being set so as to oppose an arc of positive curvature of the second fabric tape, the two fabric tapes being joined to each other at each transition between an arc of positive curvature and an arc of negative curvature by means of tie-off stitching, the plurality of such tie-offs forming accommodation means for a pull cord of a curtain.

Preferred embodiments of the invention are the subject matter of the sub claims.

By means of the above combination of features in the ribbon-type device for effecting undulation according to the invention, the alternating arcs of the functional contracting and expanding unit act as backing elements for a pull cord, and it is possible to keep the arcs so small by virtue of their design that parts of the human body, including those of children, cannot get caught up between the arcs. Furthermore, the contracting and expanding unit of the invention forms a safe accommodation means for a pull cord so that the possibility of the pull cord forming artificial loops is highly improbable.

According to a first preferred embodiment of the device of the invention, the tie-offs are spaced from each other at equal intervals. Preferably, the distance between any two adjacent tie-offs ranges from 0.5 cm to 2 cm.

According to an important preferred embodiment of the device of the invention, the warp threads of each fabric tape cross each other in the region of the tie-off stitching, and the two tapes of fabric are securely joined to each other by interweaving of the weft threads of each fabric tape. Preferably, the two fabric tapes of the functional unit are each made of soft multifilament yarns.

According to a further preferred embodiment of the device of the invention, the functional unit comprising the two tapes of fabric is attached to a tape of backing fabric that has a larger width than the two tapes of fabric and that is intended for application of the functional unit to a curtain.

Preferably, the backing fabric is made of robust monofilaments, the diameter of which is larger than that of the multifilament yarns in the fabric tapes of the functional unit.

According to another preferred embodiment of the device of the invention, the functional unit is attached to the backing fabric by interweaving the arcs of negative curvature of any one of the two tapes of fabric with the backing fabric. Preferably, the other of the two fabric tapes of the functional unit is not interwoven with the backing fabric so that an isolated arc of negative curvature is formed.

The functional unit of said two fabrics is preferably attached to a tape of backing fabric so as to form a plurality of isolated arcs. The length of an arc can be variably predefined for different curtains, in order to predefine the folds formed in a curtain.

The curtain is preferably attached to the tape of backing fabric. Therein, the curtain is preferably attached to the tape of backing fabric in that the curtain is sewn to the backing fabric by means of two seams running parallel to said pull cord. Preferably, the seams do not include said two fabrics.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

The device of the invention is explained below with reference to a preferred embodiment illustrated in the figure of the drawings. In the drawings.

Like reference numbers and designations in the various drawings indicate like elements.

DETAILED DESCRIPTION

Figure 1:
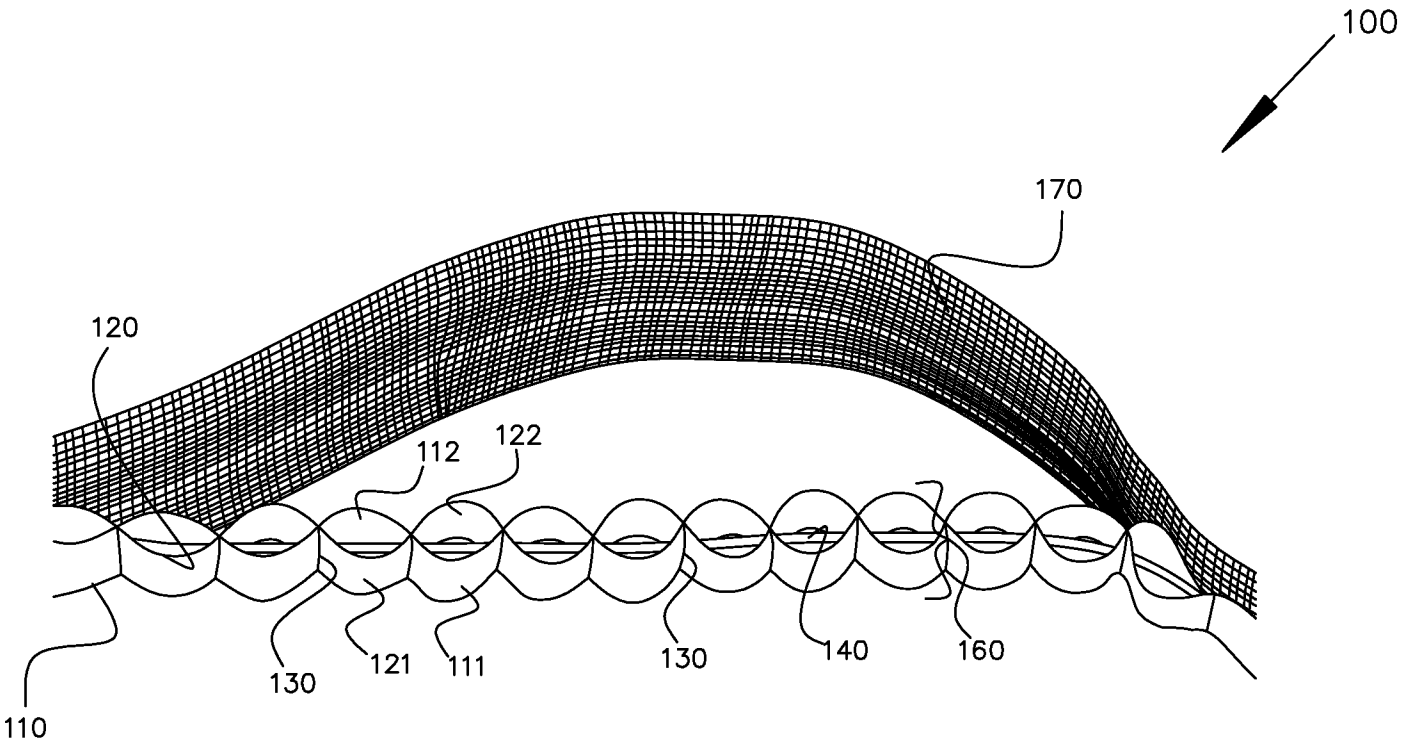
FIG. 1 shows a preferred embodiment of the ribbon-type device for effecting undulation according to the invention in a view taken obliquely from above.
Figure 2:
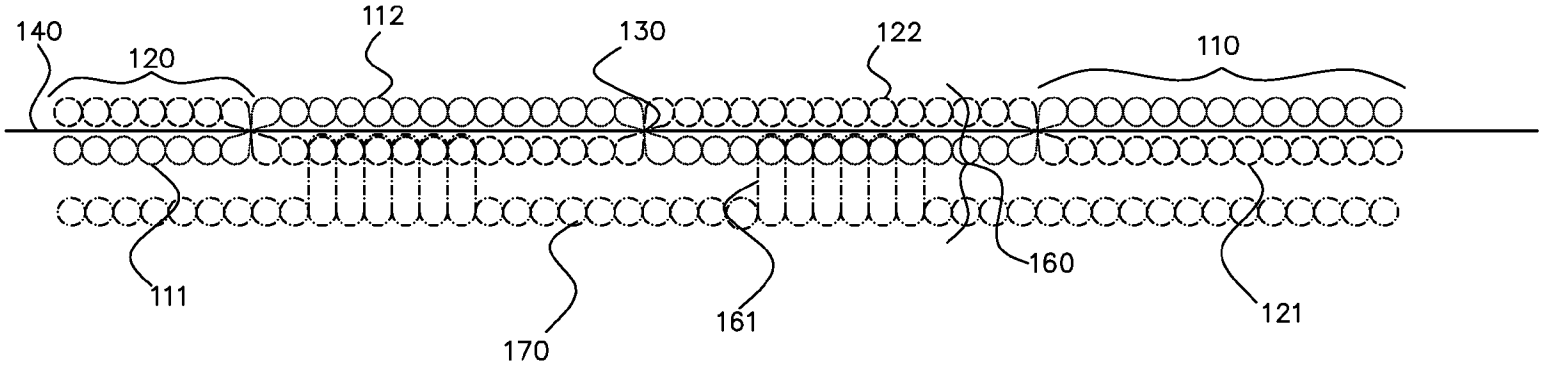
FIG. 2 is a detail of the preferred embodiment of the ribbon-type device shown in FIG. 1.
Figure 3:
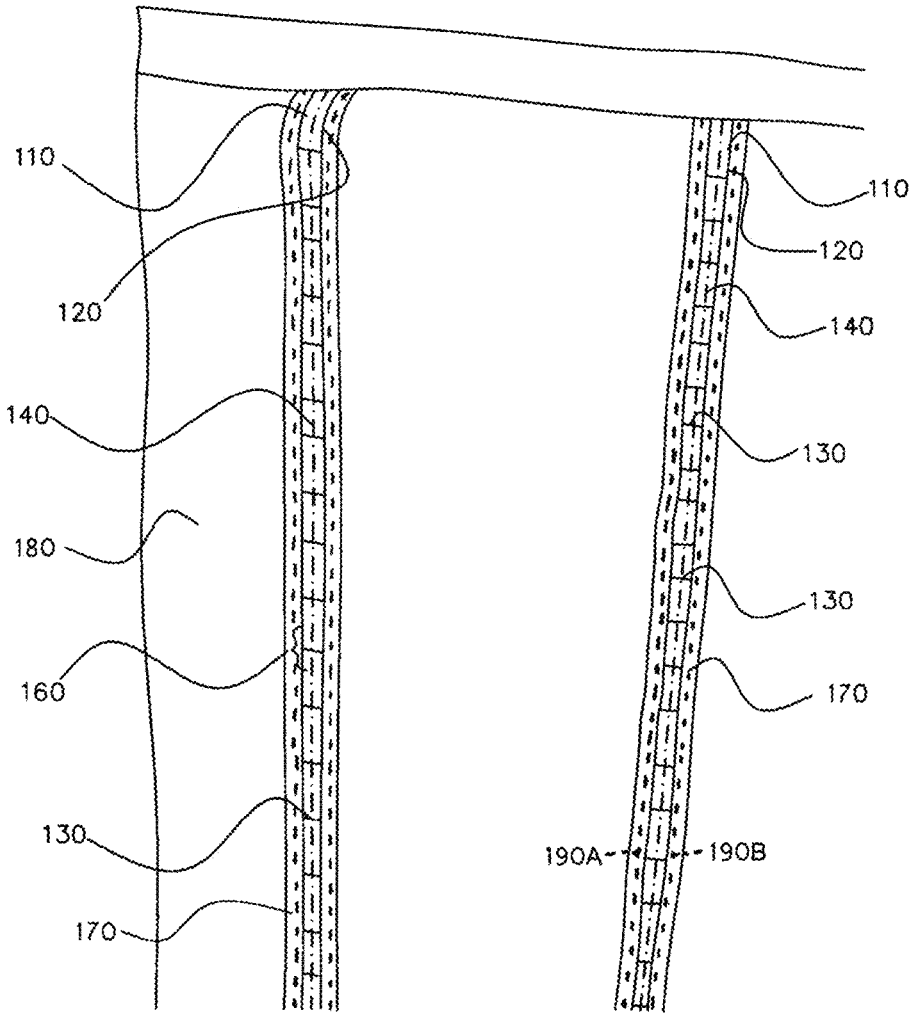
FIG. 3 is a view taken obliquely from above of the ribbon-type device shown in FIG. 1 together with an non-gathered curtain.
Figure 4:
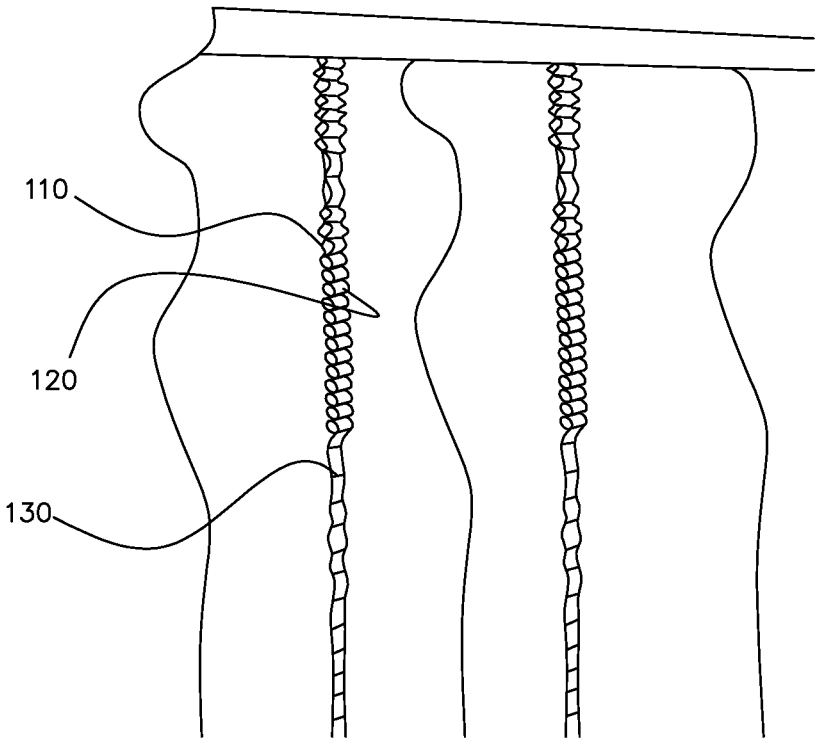
FIG. 4 is a view taken obliquely from above of the ribbon-type device shown in FIG. 1 together with an gathered curtain.

The ribbon-type device 100 for effecting undulation according to the invention as shown in FIG. 1 represents an accommodation means for a pull cord 140 of a curtain for gathering the same in the vertical or horizontal direction and comprises a functional unit 160 comprising two tapes of fabric 110, 120.

Each of the two fabric tapes 110, 120 extends in an undulating manner to form a plurality of alternating positively and negatively curved arcs 111, 121, 112, 122, an arc of positive curvature 111 of the first fabric tape 110 being set so as to oppose an arc of negative curvature 122 of the second fabric tape 120 and an arc of negative curvature 112 of the first fabric tape 110 being set so as to oppose an arc of positive curvature 121 of the second fabric tape 120.

Furthermore, the two fabric tapes 110, 120 are joined to each other at each transition between an arc of positive curvature 111, 121 and an arc of negative curvature 112, 122 by way of tie-off stitching 130, the plurality of such tie-offs 130 forming an accommodation means for a pull cord 140 of a curtain. The tie-offs 130 are spaced from each other at equal intervals of approximately 1 cm.

The warp threads of each fabric tape 110, 120 cross each other in the region of the tie-off stitching 130, and the two tapes of fabric 110, 120 are securely joined to each other by interweaving of the weft threads of each fabric tape. The two fabric tapes 110, 120 of the functional unit 160 are each made of soft multifilament yarns.

The functional unit 160 comprising the two tapes of fabric 110, 120 is attached to a tape of backing fabric 170 that has a larger width than the two tapes of fabric 110, 120 and that is intended for application of the functional unit 160 to a curtain. The backing fabric 170 comprises robust monofilaments, the diameter of which is larger than that of the multifilament yarns in the fabric tapes 110, 120 of the functional unit 160.

The functional unit 160 is attached to the backing fabric 170 by interweaving of the arcs of negative curvature 112, 122 of any one of the two tapes of fabric 110, 120 with the backing fabric 170, whilst the other of the two fabric tapes 110, 120 of the functional unit 160 is not interwoven with the backing fabric 170, so that an isolated arc of negative curvature 112, 122 is formed.

The functional unit (160) of said two fabrics (110, 120) is attached to a tape of backing fabric (170) so as to form a plurality of isolated arcs. The length of an arc can be variably predefined for different curtains, in order to predefine the folds formed in a curtain.

The curtain material 180 is attached to each tape of backing fabric (170). The curtain material is attached to the tape of backing fabric (170) in that the curtain material is sewn to the backing fabric (170) by means of two seams 190A, 190B running parallel to said pull cord. The seams do not include said two fabrics (110, 120).

The exemplary embodiment of the invention explained above merely serves the purpose of providing better comprehension of the teaching of the invention defined in the claims, which teaching is not, as such, restricted to the exemplary embodiment.

What is claimed is:

1. A curtain comprising:

a curtain material;

a first pull cord;

a second pull cord;

a first ribbon device for effecting undulation of the curtain and accommodating the first pull cord; and a second ribbon device for effecting undulation of the curtain and accommodating the second pull cord, wherein each ribbon device comprises:

a functional unit (160) comprising two fabric tapes (110, 120) wherein:

two fabric tapes (110, 120) extend in an undulating manner to form a plurality of alternating positively and negatively curved arcs (111, 121, 112, 122);

an arc of positive curvature (111) of a first fabric tape (110) is set so as to oppose an arc of negative curvature (122) of a second fabric tape (120) and an arc of negative curvature (112) of said first fabric tape (110) is set so as to oppose an arc of positive curvature (121) of said second fabric tape (120);

the two fabric tapes (110, 120) are joined to each other at a transition between an arc of positive curvature (111, 121) and an arc of negative curvature (112, 122) by way of tie-off stitching (130) forming a plurality of tie-offs; and the plurality of tie-offs (130) accommodates an associated said first or second pull cord (140) of the curtain; and a tape of backing fabric (170) attached to the functional unit and to the curtain, the tape of backing fabric of the first ribbon device being separate from the tape of backing fabric of the second ribbon device.

2. The curtain as defined in claim 1, characterized in that:

for each of the first ribbon device and second ribbon device, the curtain is attached to the respective tape of backing fabric by two parallel seams running parallel to the associated first or second pull cord.

3. The curtain of claim 2, characterized in that:

for each of said first ribbon device and second ribbon device, said two parallel seams do not include the first fabric tape and the second fabric tape.

4. The device as defined in claim 3, characterized in that:

said backing fabric (170) is interwoven with only one of said two fabric tapes (110, 120).

5. The device as defined in claim 1, characterized in that:

said backing fabric (170) is interwoven with only one of said two fabric tapes (110, 120).

* * * * *